US011098418B2

(12) United States Patent
Mandawewala et al.

(10) Patent No.: US 11,098,418 B2
(45) Date of Patent: Aug. 24, 2021

(54) PROCESS AND SYSTEM FOR MANUFACTURING TWISTED AND TEXTURED YARNS

(71) Applicant: Abhishek Mandawewala, Mumbai (IN)

(72) Inventors: Abhishek Mandawewala, Mumbai (IN); Vinay Kumar R M, Bangalore (IN)

( * ) Notice: Subject to any disclaimer, the term of this patent is extended or adjusted under 35 U.S.C. 154(b) by 0 days.

(21) Appl. No.: 15/762,569

(22) PCT Filed: Dec. 7, 2017

(86) PCT No.: PCT/IB2017/057714
§ 371 (c)(1),
(2) Date: Mar. 23, 2018

(87) PCT Pub. No.: WO2019/064056
PCT Pub. Date: Apr. 4, 2019

(65) Prior Publication Data

US 2020/0224339 A1 Jul. 16, 2020

(30) Foreign Application Priority Data

Sep. 27, 2017 (IN) ..... 201721034321

(51) Int. Cl.

| | |
|---|---|
| ***D02G 1/20*** | (2006.01) |
| ***D02G 1/16*** | (2006.01) |
| ***D02G 3/28*** | (2006.01) |
| ***D02J 1/08*** | (2006.01) |

(52) U.S. Cl.
CPC ..... *D02G 1/20* (2013.01); *D02G 1/161* (2013.01); *D02G 3/28* (2013.01); *D02J 1/08* (2013.01)

(58) Field of Classification Search
CPC D02G 1/16; D02G 1/161; D02G 1/20; D02G 3/28; D02G 3/36; D02G 3/38; D02J 1/08
See application file for complete search history.

(56) References Cited

U.S. PATENT DOCUMENTS 5,359,759 A * 11/1994 Jacob ..... D02G 1/205 28/240
5,581,858 A * 12/1996 Curran ..... D02G 1/165 28/258
5,794,427 A 8/1998 Cavedon et al.
5,802,836 A * 9/1998 Curran ..... D02G 1/162 28/220

(Continued)

*Primary Examiner* — Shaun R Hurley
(74) *Attorney, Agent, or Firm* — Rumit Ranjit Kanakia

(57) ABSTRACT

A process and system for manufacturing twisted and textured yarns are provided. The process includes drawing a first material yarn from a first supply source under predetermined tension; heatingly extending the first material yarn through at least one first heating godet; drawing a second material yarn from a second supply source under predetermined tensions; heatingly extending the second material yarn through at least one second heating godet; feeding at least one of the first material yarn and the second material yarn in an Air Textured Unit (ATY) to obtain a third material yarn; winding the third material yarn exiting from the ATY, wherein the winding is a pirn winding process; twisting the first material yarn, the second material yarn and the third material yarn; and rewinding the twisted third material yarn.

17 Claims, 1 Drawing Sheet

(56) References Cited

U.S. PATENT DOCUMENTS

| | | | | |
|---|---|---|---|---|
| 6,055,712 | A * | 5/2000 | Thoma | D02G 1/161 28/220 |
| 6,085,395 | A * | 7/2000 | Weiss | D02G 1/12 28/221 |
| 6,105,224 | A | 8/2000 | Dotson et al. | |
| 6,240,609 | B1 * | 6/2001 | Rasnick, Jr. | D02G 1/161 28/258 |
| 6,374,470 | B1 * | 4/2002 | Goineau | D02G 1/20 28/220 |
| 7,678,450 | B2 * | 3/2010 | Kitamura | D02J 1/00 428/370 |
| 2003/0108740 | A1 | 6/2003 | Abe et al. | |

* cited by examiner

PROCESS AND SYSTEM FOR MANUFACTURING TWISTED AND TEXTURED YARNS

TECHNICAL FIELD

The present disclosure relates to textiles industries, and, more particularly, to a process and a system for manufacturing twisted and textured yarns.

BACKGROUND ART

Twisted and texture yarns are gaining popularity in the textile industry due to its better overall performance. As known to the skilled person of the textile industry that the finished textured yarns are classified in two mail categories. Out of these two categories, in the first category, a relatively low level of thread entanglement usually supplemented by twisting to improve sewing performance; while in the second category, a high level of thread entanglement utilizing the "core and effect" principal to optimize tenacity and modulus. The latter of these two categories generally provides thread or yarn having a better overall performance as compared to the first category.

Those familiar with the art will recognize that the above mentioned second category have a better overall performance are but a few of the many teaching novelty yarn structures and associated with present methods and system.

In view of the above, a need exists a need of novel yarn having better overall performance.

SUMMARY OF INVENTION

The present disclosure discloses a process and a system for manufacturing twisted and textured yarns that will be presented in the following simplified summary to provide a basic understanding of one or more aspects of the disclosure that are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

In accordance with the above, it is general object of the present disclosure to provide a process and a system for manufacturing twisted and textured yarns have a better overall performance.

In one aspect, a process for manufacturing twisted and textured yarns is disclosed. The process includes drawing a first material yarn from a first supply source under predetermined tension; heatingly extending the first material yarn through at least one first heating godet; drawing a second material yarn from a second supply source under predetermined tensions; heatingly extending the second material yarn through at least one second heating godet; feeding at least one of the first material yarn and the second material yarn in an Air Textured Unit (ATY) to obtain a third material yarn; winding the third material yarn exiting from the ATY, wherein the winding is a pirn winding process; twisting the first material yarn, the second material yarn and the third material yarn; and rewinding the twisted third material yarn.

In one embodiment, the first material yarn may be a core yarn selected at least from a Partially Oriented Yarn (POY) or a Fully Drawn Yarn (FDY). Further, the predetermined tension of the first material yarn may be negligible. Furthermore, the at least one first heating godet may include a temperature in a range of about 125° C. to 130° C.

In one embodiment, the second material yarn may be an effect yarn, which may be a Partially Oriented Yarn (POY). Further, the predetermined tension of the second material yarn may be in the range from 1.5 to 2 percent of for material from which the effect yarn is made. Furthermore, the at least one second heating godet may include a temperature in a range of about 80° C. to 160° C.

In one embodiment, the feeding step may include overfeeding the first material yarn to the ATY in a lower range; and overfeeding the second material yarn to the ATY in a moderate range.

In one embodiment, the winding may be a pirn winding process.

In one embedment, twisting may include two-step twisting, a primary twisting step and a secondary twisting. The primary twisting may include twisting the first material yarn singularly in a range of 750 to 760 twist/meter; and twisting the second material yarn singularly in a range of 750 to 760 twist/meter. Further, the secondary twisting may include simultaneously twisting the first material yarn and the second material yarn in counter-direction to each other to obtain the third material yarn, wherein the secondary twisting is 30 percent less than that of the primary twisting on the first and second material yarns.

In one embodiment, the process for manufacturing twisted and textured yarns may further include heating the third material yarn along a heating module, upon the requirement.

In one further aspect, a system for manufacturing twisted and textured yarns is provided. The system includes a first supply source to draw a first material yarn under predetermined tension; at least one first heating godet through which the first material yarn being heatingly extended; a second supply source to draw a second material yarn under predetermined tension; at least one second heating godet through which the second material yarn being heatingly extended; an Air Textured Unit (ATY) to which the first material yarn and the second material yarn are fed to obtain a third material yarn; a winding module to wound the third material yarn exiting from the ATY; a twisting module to twisting the third material yarn; and a rewinding module to rewind the twisted third material yarn.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF DRAWINGS

Reference will be made to embodiments of the disclosure, examples of which may be illustrated in the accompanying figures. These figures are intended to be illustrative, not limiting. Although the disclosure is generally described in the context of these embodiments, it should be understood that it is not intended to limit the scope of the disclosure to these particular embodiments.

Like reference numerals refer to like parts throughout the description of several views of the drawings.

DESCRIPTION OF EMBODIMENTS

For a thorough understanding of the present disclosure, reference is to be made to the following detailed description, including the appended claims, in connection with the above-described drawings. In the following description, for purposes of explanation, numerous specific details are set forth in order to provide a thorough understanding of the present disclosure. It will be apparent, however, to one skilled in the art that the present disclosure can be practiced without these specific details. In other instances, structures and devices are shown in block diagrams form only, in order to avoid obscuring the disclosure. Reference in this specification to "one embodiment," "an embodiment," "another embodiment," "various embodiments," means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but may not be of other embodiment's requirement.

Although the following description contains many specifics for the purposes of illustration, anyone skilled in the art will appreciate that many variations and/or alterations to these details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure. Further, the relative terms, such as "first," "second" and the like, herein do not denote any order, elevation or importance, but rather are used to distinguish one element from another. Further, the terms "a," "an," and "plurality" herein do not denote a limitation of quantity, but rather denote the presence of at least one of the referenced item.

The present disclosure provides novel process and system for manufacturing twisted and textured yarns and will be described in the following with reference to an embodiment and to the example FIGS. 1 and 2, which show in schematic illustrations the individual stations of a system for carrying out the process of the disclosure.

Figure 1:
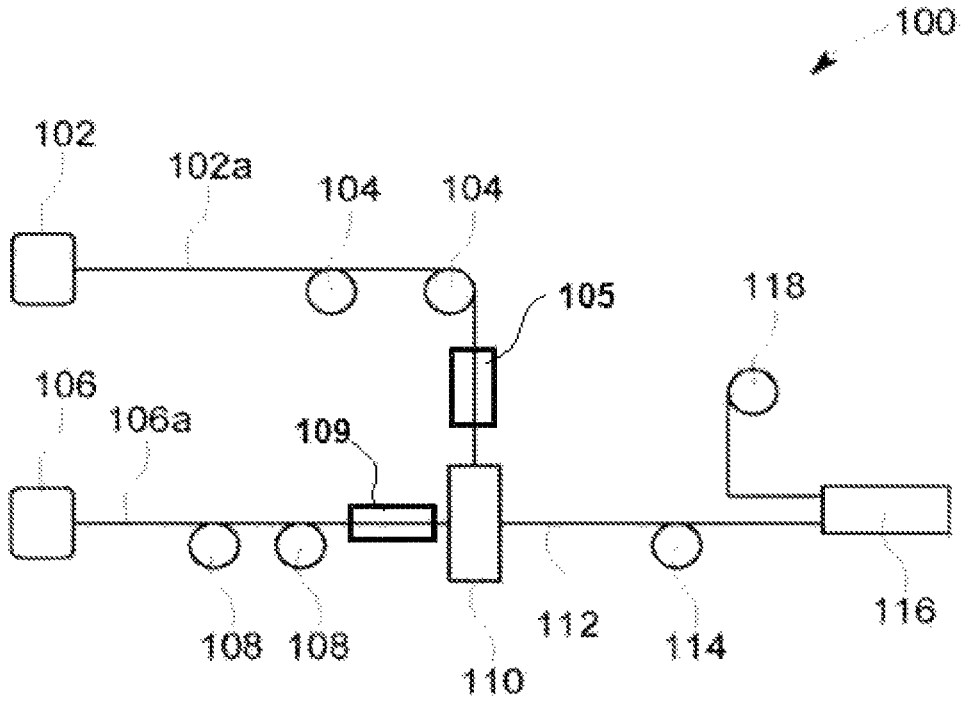
FIG. 1 is a block diagram illustrating a process flow in a system for manufacturing twisted and textured yarns, in accordance with an exemplary embodiment of the present disclosure.

Referring to FIG. 1, a system 100 for manufacturing twisted and textured yarns is disclosed. The system 100 includes a first supply source 102 to draw a first material yarn 102*a* under predetermined tension. In one embodiment, the first material yarn 102*a* may be a core yarn selected at least from a Partially Oriented Yarn (POY) or a Fully Drawn Yarn (FDY). However, without departing from the scope of the present disclosure, the first material yarn 102*a* may be any other suitable yarn that fulfills the end requirement. Further, the predetermined tension of the first material yarn 102*a* may be negligible, almost nil. However, without departing from the scope of the present disclosure, the first material yarn 102*a* may be subject to tension depending upon the nature of yarn.

Further, the first material yarn 102*a*, from the first supply source 102, is extended to at least one first heating godet 104 to heat while the first material yarn 102*a* is being heated. In one example form, the at least one first heating godet 104 may include a temperature in a range of about 125° C. to 130° C. However, without departing from the scope of the present disclosure, the temperature of the first heating godet 104 may be increased or decreased to obtain yarn as per the requirement. In the example FIG. 1, the system 100 is shown to include two first heating godet 104, however, without limiting, the first heating godet 104 may be in include any number(s), depending the requirement of the system.

The system 100 further includes a second supply source 106 to draw a second material yarn 106*a* under predetermined tension. In one embodiment, the second material yarn 106*a* may be an effect yarn, which may be a Partially Oriented Yarn (POY). However, without departing from the scope of the present disclosure, the second material yarn 106*a* may be any other suitable yarn that fulfills the end requirement. Further, the predetermined tension of the second material yarn 106*a* may be in the range from 1.5 to 2 percent of material from which the effect yarn is made. However, without departing from the scope of the present disclosure, the second material yarn 106*a* may be subject to any other tension range depending upon the nature of yarn.

Further, the second material yarn 106*a*, from the second supply source 106, is extended to at least one second heating godet 108 to heat while the second material yarn 106*a* is being heated. In one example form, the at least one second heating godet 108 may include a temperature in a range of about 80° C. to 160° C. However, without departing from the scope of the present disclosure, the temperature of the second heating godet 108 may be increased or decreased to obtain the yarn, as per the requirement. As shown in example FIG. 1, the system 100 is shown to include two second heating godet 108, similar to the first heating godet 104, however, without limiting, the second heating godet 108 may be in include any number(s), depending the requirement of the system.

Such heating of the first and second material yarns 102*a*, 106*a*, respectively, through the heating godet 104, 108 may soften the yarn during drawing, so that the likelihood of rupture of the yarn filaments are thus reduced.

The system 100, as shown in FIG. 1, further includes an Air Textured Unit (ATY) 110 to which the first material yarn 102*a* and the second material yarn 106*a* are fed to obtain a third material yarn 112. In one embodiment, the feeding in the ATY 110 may include overfeeding of the first material yarn 102*a* to the ATY 110 in a lower range, and overfeeding of the second material yarn 106*a* to the ATY 110 in a moderate range. The amount of overfeed of the first material yarn 102*a* may be in a range 3% to 15% and is determined by the end use of the finished product and the denier of the first material yarn 102*a* used. Further, The amount of overfeed of the second material yarn 106*a* may be in a range 15% to 35% and is determined by the end use of the finished product and the denier of the second material yarn 106*a* used. Furthermore, with a higher or lower denier of the first material yarn 102*a* or the second material yarn 106*a*, the amount of overfeed may vary. It should also be understood that passing of the first and second material yarns through the ATY 110 significantly aids the aspiration and entanglement of the first and second material yarns 102*a*, 106*a*. The first and second material yarns 102*a*, 106*a* may cause to be intermingle with each other in a mixing chamber (not shown) of the ATY 110, the air or fluid entering the ATY 110. As will be readily appreciated by those of ordinary skill in the art, the position of the ATY 110 determines the degree of aspiration and entanglement of the yarns.

The system 100, as shown in FIG. 1, further includes a winding module 114 to wound the third material yarn 112 exiting from the ATY 110. In one embodiment, the winding module 114 onto which the third material yarn 112 is wound for subsequent processing may include a pirn winding process. However, without departing from the scope of the present disclosure, the other winding process apart from the pirn winding process may also be used depending upon the industrial requirement.

The system 100, as shown in FIG. 1, further includes twisting of the material yarns, such as, the first material yarn 102*a*, second material yarn 106*a* and the third material yarn 112. In one embedment, the system 100 may include a twisting module 116, such as twister bobbin and a thread guide for subsequent twisting of the third material yarn 112.

In the preferred embodiment, such twisting process may include two-step twisting, a primary twisting step and a secondary twisting step. The primary twisting step may include twisting of the first material yarn 102*a* singularly in a range of 750 to 760 twist/meter. Further, the primary twisting step also includes twisting of the second material yarn 106*a* singularly in a range of 750 to 760 twist/meter. More or less, a ratio of the twist of the first material yarn 102*a* and the second material yarn 106*a* in the primary twisting step may substantially be about 1. However, without departing from the scope of the present disclosure such twist ratio between the first material yarn 102*a* and the second material yarn 106*a* may have a tolerance to be approaching towards 1. The primary twisting step may be performed before the ATY 110, or while the first and second material yarns 102*a*, 106*a* are being fed in the ATY 110. Further, the secondary twisting step may include, simultaneously, twisting the first material yarn 102*a* and the second material yarn 106*a* one over the other in counter-direction to each other to obtain the third material yarn 112. In one preferred embodiment, twist obtained during the secondary twisting step on the third material yarn 112 may be 30 percent (30%) less than the twist obtained during the primary twisting step on the first and second material yarns 102*a*, 106*a*. The secondary twisting step occurs after the ATY 110 and the winding module 114 along the twisting module 116, while twisting of the first and second material yarns 102*a*, 106*a* during the primary twisting step may be done before or after the ATY 110, by a first twisting module 105 and a second twisting module 109, respectively.

The system 100 further includes a rewinding module 118, to rewind the twisted third material yarn 112 thereon for further use, for example, a bobbin with wounded third material yarn 112 may be used for manufacturing the cloths.

Figure 2:
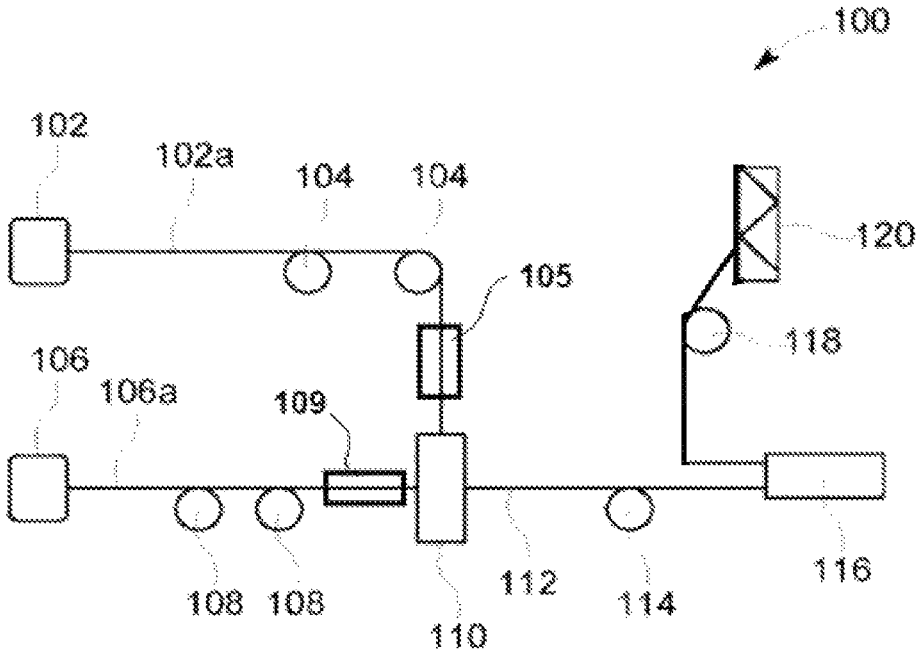
FIG. 2 is a block diagram illustrating a process flow in a system for manufacturing twisted and textured yarns, in accordance with an additional exemplary embodiment of the present disclosure.

In one additional embodiment, the system 100, as shown in FIG. 2, may include a heating module 120 to heat the third material yarn 112, upon the requirement. All the above steps as described with conjunction to FIG. 1 are similar, and only the heating of the third material yarn 112 of this embodiment is additional. For the sake of brevity, the repetition of the steps as described above is avoided. Such heating of the third material yarn 112 may improve the highly entangled third material yarn 112 around a heated roller (not shown) of the heating module 120 to form a set third material yarn 112, while preventing said highly entangled loop yarn from contracting and preserving said surface loops in said yarn.

Thus, the present disclosure provides a unique and novel process and system for manufacturing twisted and textured yarns. Accordingly, the present disclosure is advantageous in that it produces a yarn in which the possibility of rupture of the effect yarn is greatly reduced. It also produces a better quality finished product in addition to increasing the yield and the efficiency of the methods. Furthermore, subsequent twisting of the air entangled product improves sewing performance.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A process for manufacturing twisted and textured yarns; the process comprising:

drawing a first material yarn from a first supply source;

heatingly extending the first material yarn through at least one first heating godet;

twisting of the first material yarn individually prior to feeding the first material yarn in an Air Textured Unit (ATY) to obtain a twisted first material yarn;

drawing a second material yarn from a second supply source under predetermined tension;

heatingly extending the second material yarn through at least one second heating godet;

twisting of the second material yarn individually prior to feeding the second material yarn in the ATY to obtain a twisted second material yarn;

feeding the twisted first material yarn and the twisted second material yarn in the ATY to obtain a third material yarn;

winding the third material yarn exiting from the ATY on a winding module;

twisting the third material yarn upon unwinding the third material yarn from the winding module to obtain a twisted third material yarn;

rewinding the twisted third material yarn.

2. The process as claimed in claim 1, wherein the first material yarn is selected at least from a Partially Oriented Yarn (POY) or a Fully Drawn Yarn (FDY).

3. The process as claimed in claim 1, wherein the at least one first heating godet comprises a temperature in a range of about 125° C. to 130° C.

4. The process as claimed in claim 2, wherein the second material yarn is a Partially Oriented Yarn (POY).

5. The process as claimed in claim 4, wherein the predetermined tension in the second material yarn is 1.5 to 2 percent more as compared to an original second material yarn.

6. The process as claimed in claim 1, wherein the at least one second heating godet comprises a temperature in a range of about 80° C. to 160° C.

7. The process as claimed in claim 1, wherein the feeding step comprises: overfeeding the first material yarn to the ATY in a range of 3-15% faster than a production rate of the third material yarn; and overfeeding the second material yarn to the ATY in a range of 15-35% faster than the production rate of the third material yarn.

8. The process as claimed in claim 1, wherein the first material yarn is twisted in a range of 750 to 760 twist/meter; and the second material yarn is twisted in a range of 750 to 760 twist/meter.

9. The process as claimed in claim 1, wherein twist on the third material yarn is of 30 percent lesser amount than that of the twists on each of the first and second material yarns.

10. The process as claimed in claim 1, further comprises a heating the twisted third material yarn along a heating module disposed adjacent to the twisting module.

11. A system for manufacturing twisted and textured yarns, the system comprising:

a first supply source to draw a first material yarn;

at least one first heating godet through which the first material yarn being heatingly extended;

a first twist module to twist the first material yarn;

a second supply source to draw a second material yarn under predetermined tension;

at least one second heating godet through which the second material yarn being heatingly extended;

a second twist module to twist the second material yarn;

an Air Textured Unit (ATY) to which the twisted first material yarn and the twisted second material yarn are fed to obtain a third material yarn;

a winding module to wind the third material yarn exiting from the ATY;

a twisting module to twist the third material yarn received from unwinding the third material yarn from the winding module a rewinding module to rewind the third twisted material yarn.

12. The system as claimed in claim 11, wherein the second supply source draws the second material yarn at the predetermined tension of 1.5 to 2 percent more as compared to an original second material yarn.

13. The system as claimed in claim 11, wherein the at least one first heating godet comprises a temperature in a range of about 125° C. to 130° C., and the at least one second heating godet comprises a temperature in a range of about 80° C. to 160° C.

14. The system as claimed in claim 11, wherein, in the ATY, the first material yarn is overfed in a range of 3-15% faster than a production rate of the third material yarns and the second material yarn is overfed in a range of 15-35% faster than the production rate of the third material yarns.

15. The system as claimed in claim 11, wherein the first material yarn is twisted in a range of 750 to 760 twist/meter; and the second material yarn is twisted in a range of 750 to 760 twist/meter.

16. The system as claimed in claim 11, wherein twist on the third material yarn is of 30 percent lesser amount than that of the twists on each of the first and second material yarns.

17. The system as claimed in claim 11, further comprises a heating module disposed adjacent to the twisting module to heat the twisted third material yarn.

* * * * *